United States Patent [19]

Hughes

[11] 4,190,255

[45] Feb. 26, 1980

[54] WORD GAME APPARATUS

[76] Inventor: Charles F. M. Hughes, P. O. Box 142, Bakerstown, Pa. 15007

[21] Appl. No.: 855,679

[22] Filed: Nov. 29, 1977

Related U.S. Application Data

[63] Continuation of Ser. No. 708,588, Jul. 26, 1976, abandoned.

[51] Int. Cl.[2] ..... A63F 3/00

[52] U.S. Cl. ..... 273/272

[58] Field of Search ..... 273/272, 243

[56] References Cited

U.S. PATENT DOCUMENTS

| | | | |
|---|---|---|---|
| 485,029 | 10/1892 | Conkling | 273/243 |
| 1,240,756 | 9/1917 | Moore | 273/243 |
| 2,232,055 | 2/1941 | Davis | 273/243 |
| 2,752,158 | 6/1956 | Brunot et al. | 273/272 |
| 3,472,514 | 10/1969 | Green | 273/272 |
| 3,904,207 | 9/1975 | Gold | 273/272 |

FOREIGN PATENT DOCUMENTS

| | | | |
|---|---|---|---|
| 1537012 | 7/1968 | France | 273/272 |
| 747598 | 4/1956 | United Kingdom | 273/272 |

OTHER PUBLICATIONS

"Scrabble", Selchow & Righter Co., Playthings Catalog, Jan. 1956, p. 4.

*Primary Examiner*—Richard C. Pinkham
*Assistant Examiner*—R. Carl Moy
*Attorney, Agent, or Firm*—Buell, Blenko & Ziesenheim

[57] ABSTRACT

A board game, for being played competitively between several players, and wherein the game board has a playing field, that is divided into hexagonal playing spaces, so that rows of spaces can be made in three different directions, the spaces each being adaptable to have a playing piece placed thereupon, and which has an alphabetical letter imprinted thereupon, so that words can be formed in three different directions, so that letters, of words in one direction, can also comprise a letter of words in other directions.

5 Claims, 5 Drawing Figures

WORD GAME APPARATUS

This application is a continuation of my copending application Ser. No. 708,588, filed July 26, 1976, now abandoned.

This invention relates generally to board games. More specifically, it relates to word games.

A principal object of the present invention is to provide a word game and word game apparatus, in which words are formed, extending in three different directions, so that letters of a word in one direction can also serve as letters or words extending in other directions.

Another object of the present invention is to provide a word game, which can be played competitively between several players so as to provide diversion and entertainment, while at a same time being educational for all participants.

Another object is to provide a word game apparatus, which is of long playing type, and which can take several hours of time to play to its end, and wherein a conclusion of the game may be decided upon, previous to this time, by arrangement between the players, in order to determine a highest scoring player as a winner.

Other objects are to provide a Gramot word game, which is simple in design, inexpensive to manufacture, rugged on construction, easy to use and efficient in operation.

These and other objects will be readily evident upon a study of the following specification, and the accompanying drawing, wherein.

Figure 1:
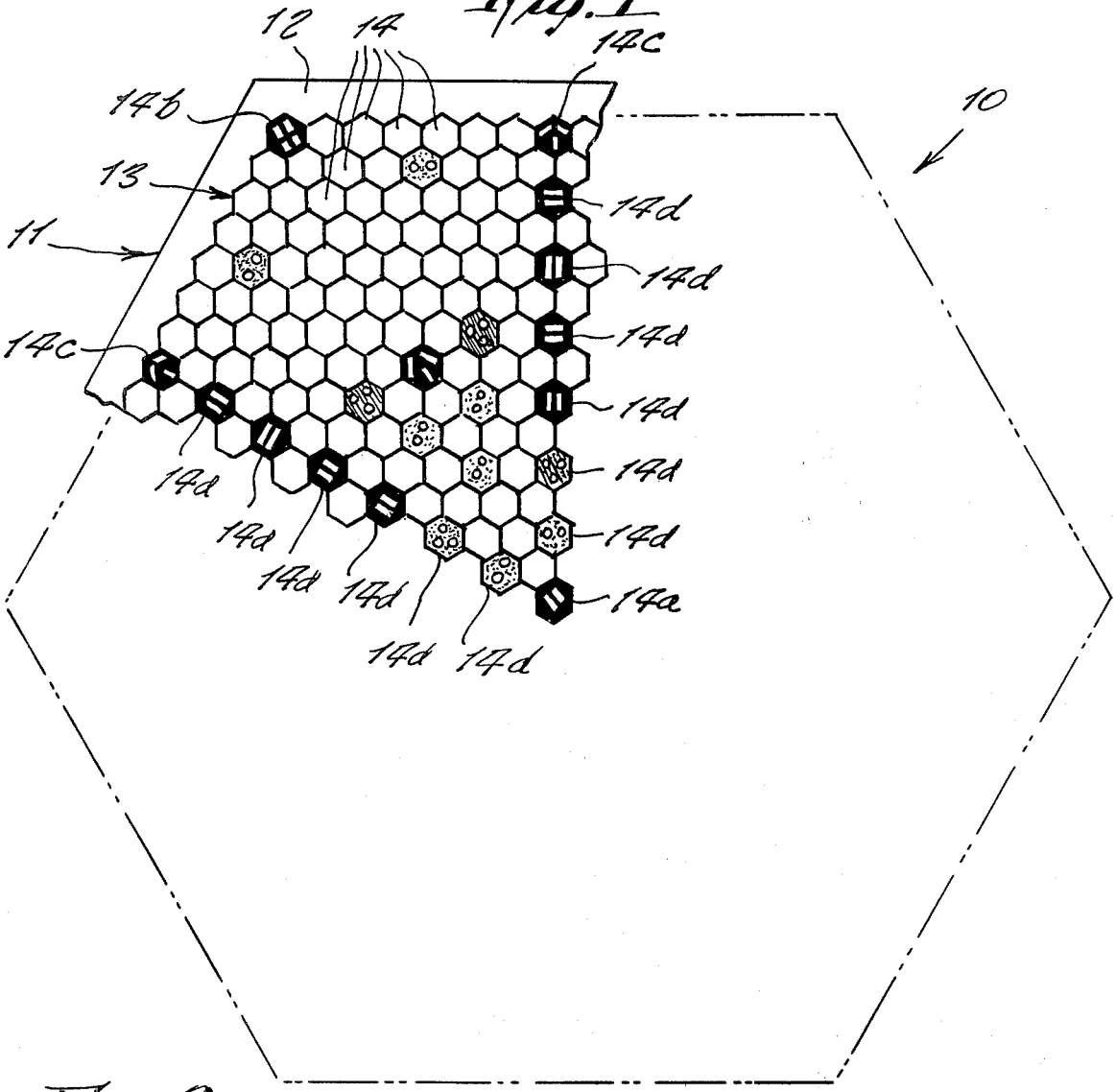
FIG. 1 is a fragmentary plan view of the game board, and which illustrates a typical playing space arrangement, that is used throughout the entire playing field of the board.
Figure 2:
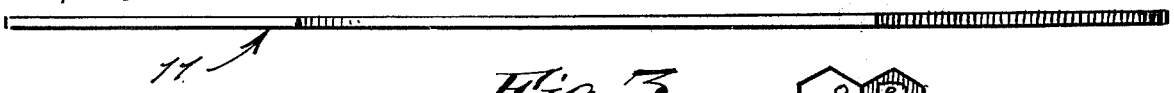
FIG. 2 is a side edge view of the game board.

Referring now to the drawing in greater detail, reference numeral 10 represents a Gramot word game, according to the present invention, wherein there is a game board 11, which is of hexagonal shape, and which may be of relatively large size, that may be up to several feet across. Upon the upper side 12, of the game board 11, there is imprinted a playing field 13, that is divided into a plurality of hexagonal spaces 14, adjacent each other, so that together they form rows of spaces, that extend into three different directions, crossing each other. In FIG. 1, only a portion of the playing field is illustrated, the illustrated portion illustrating one sixth of the entire area of the playing field, and which illustrates a typical section thereof, wherein the space **14*a* is at a center of the playing field, while a space 14*b* is at a corner of the playing field. Midway between each corner playing space 14*b* there is a space 14*c*, which is located on the periphery of the playing field, and from whence a row of playing spaces 14*d*, located spaced apart from each other equi-distant, are at sixty degrees from a row of like spaces 14*d*, which extend between another peripheral mid-space 14*c*, and the central space 14*a***. As is clearly shown in FIG. 1, various representations are imprinted upon certain of the spaces, as is indicated by the particular shade, bars and circles thereupon. Each of these are representations of values, as is indicated in the following table of statistics.

| Statistics | | |
|---|---|---|
| Total number of playing hexes | = 645 | |
| Total quadruple word scores | = 6 | color yellow with 4 squares |
| Total triple word scores | = 12 | color red with 3 squares |
| Total double word scores | = 25 | color pink with 2 squares |
| Total triple letter scores | = 24 | color dark blue with 3 circles |
| Total double letter scores | = 36 | color light blue with 2 circles |
| Total number of playing letters | = 283 | |
| A=1 point value (25 in game) | M=3 (6 in game) | Y=4 (6 in game) |
| B=3 point value (6 in game) | N=1 (16 in game) | Z=10 (3 in game) |
| C=3 pont point (6 in game) | O=1 (22 in game) | blanks=0 (7 in game) |
| D=2 point value (11 in game) | P=3 (6 in game) | |
| E=1 point value (34 in game) | Q=10 (3 in game) | |
| F=3 point value (6 in game) | R=1 (16 in game) | |
| G=2 point value (8 in game) | S=1 (11 in game) | |
| H=3 point value (6 in game) | T=1 (17 in game) | |
| I=1 point value (25 in game) | U=1 (11 in game) | |
| J=8 point value (33 in game) | V=4 (6 in game) | |
| K=3 point value (3 in game) | W=4 (6 in game) | |
| L=2 point value (11 in game) | X=8 (3 in game) | |

Figure 3:
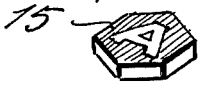
FIG. 3 is a perspective view of a typical playing piece, with an alphabetical character indicated thereupon.

In playing the word game of of this invention, two to six players may play, each player draws a letter playing piece 15, as shown in FIG. 3, and the player obtaining the playing pieces with the alphabetical letter that is closest to the start of the alphabet starts the game, after these initial playing pieces are put back into the bag. Thereafter, the player starting the game draws seven playing pieces, and passes the bag clockwise to the next player. All turns are played in a clockwise manner. Each play by the player represents his or her turn. All the turns are clockwise around the board, and make a round of play.

Figure 4:
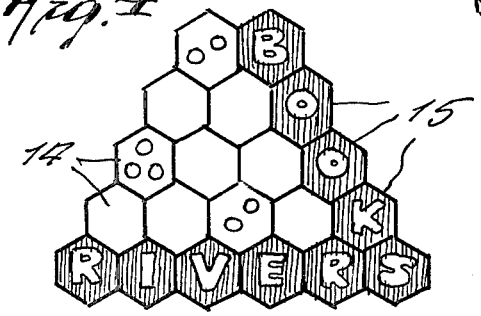
FIG. 4 illustrates a fragmentary plan view of the game board, showing one example of the game in progress.
Figure 5:
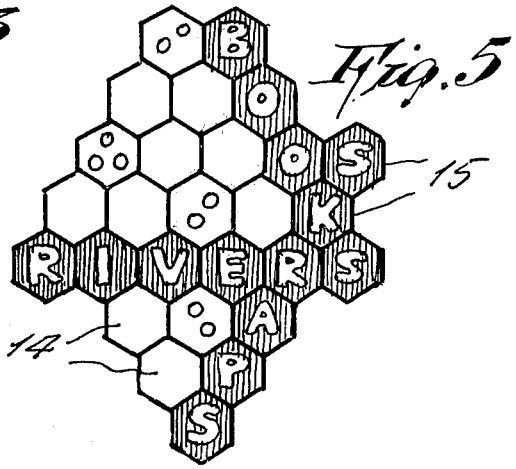
FIG. 5 is a view similar to FIG. 4, and showing another example of the game, in which further progress is made to the game as shown in FIG. 4.

A play is always from a left to a right. This is clearly shown in the example illustrated in FIGS. 4 and 5.

All the letters without numbers are equal to the value of one. All letters with numbers are equal to the value shown. Blanks have no value, and can be used to represent any letter desired. Thus, non-words are produced.

In order for the word game apparatus of this invention to function properly, two or less non-words may be formed during a turn, as a result of playing a good word with the letters played in one direction. A turn represents letters a player puts on the board in one direction to form a word. No abbreviations, contractions and proper names are permitted. If, in the play, words are formed as a by-product of the word played, these words may have their values totaled into the score. Non-words, of which there may be no more than two, as a result of by-product of a word laid down, do not count against a score, nor add to it. If a word is played that was on the board, in part, before a player decides to lengthen the word, he may be allowed to have more than two non-words. Non-words counted are non-words which were a direct result of the spaces upon which playing pieces are placed during a turn. Non-words, which were not adjacent to spaces played upon, do not count against the total of the two non-words permitted during a turn. Plays made at a beginning or end of words are acceptable when the word played upon is still a word as a result of the play, or a word was formed from the word added to, as a by-product word from the original word.

Circles designed within the hexes, or spaces, represent letter scores, and rectangular squares, within the hexes or spaces, represent word scores. Letters played on word scores increase the value of all the letters forming a word through the word score hex played upon by the total of value of the words formed, multiplied by the value of the hex. Letters played in hexes having circles marked thereupon, have their value multiplied times the number of circles in the hex. In a given word played, the scope is the sum of all the letters, and letter scores multiplied by the word score, if any.

If a player plays all seven letters out during his turn, the player doubles the value of his turn score. Optional game plays are to use ten letters, instead of seven letters. If a player plays all ten in one turn, he triples his score.

Thus, there is provided a Gramot word game.

While various changes may be made in the detail construction, it is understood that such changes will be within the spirit and scope of the present invention as is defined by the appended claims.

What I claim is:

1. A word game apparatus, comprising a game board and a plurality of playing pieces for placement on said game board, said game board having a hexagonal playing field imprinted on the upper surface thereof in the form of a regular honeycomb pattern of smaller hexagonal spaces providing three different intersecting directions of play from left to right, the smaller hexagonal spaces at each corner carrying an indicia thereon representing a score multiplier, three connecting lines of hexagonal spaces extending from substantially the midpoint of each side of the hexagonal playing field to a like point on the opposite side dividing the playing field into six substantially equal generally pie-shaped areas each embracing 60° of the playing field between the midpoints of adjacent sides and including the corners of said hexagonal playing field, said lines intersecting at the center of the playing field, each of the hexagonal areas of each said line carrying an indicia indicating a score multiplier, a plurality of spaced score multiplier hexagonal areas arranged in each generally pie-shaped area, each having a fixed multiplier value, and word forming characters on each of said playing pieces, said playing pieces being hexagonal in shape and adapted to fit on any hexagonal space on the playing field, whereby words may be formed in three directions and letters of a word in one direction may serve as letters of a word in the other two directions.

2. The game apparatus as claimed in claim 1 wherein the playing pieces each carry a single alphabetical letter imprinted thereon.

3. The game apparatus as claimed in claim 1 wherein the indicia indicating a score multiplier is one of a color, and a geometric figure, each different color and different figure indicating a different muliplier.

4. The game apparatus as claimed in claim 3 wherein the geometric figure is one of a multiplicity of bars and circles.

5. The game apparatus as claimed in claim 4 wherein said circles represent letter scores and said bars represent word scores.

* * * * *